US008731424B2

(12) United States Patent
Sano et al.

(10) Patent No.: US 8,731,424 B2
(45) Date of Patent: May 20, 2014

(54) IMAGE FORMING APPARATUS

(75) Inventors: Tetsuya Sano, Mishima (JP); Yuki Nishizawa, Susono (JP); Akira Kato, Mishima (JP); Kentaro Yamashita, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 126 days.

(21) Appl. No.: 13/312,111

(22) Filed: Dec. 6, 2011

(65) Prior Publication Data

US 2012/0148283 A1 Jun. 14, 2012

(30) Foreign Application Priority Data

Dec. 10, 2010 (JP) ..... 2010-276165

(51) Int. Cl.
*G03G 15/20* (2006.01)
*G03G 15/00* (2006.01)

(52) U.S. Cl.
CPC ..... *G03G 15/2039* (2013.01); *G03G 15/205* (2013.01); *G03G 15/2053* (2013.01); *G03G 15/2078* (2013.01); *G03G 15/80* (2013.01)
USPC ..... 399/69; 399/44; 399/68; 399/329

(58) Field of Classification Search
CPC ..... G03G 15/2053; G03G 15/80
USPC ..... 399/44, 69, 329
See application file for complete search history.

(56) References Cited

U.S. PATENT DOCUMENTS

| | | | | |
|---|---|---|---|---|
| 5,229,577 | A * | 7/1993 | Matsuura et al. | 219/497 |
| 7,116,923 | B2 * | 10/2006 | Kishi et al. | 399/69 |
| 2002/0012544 | A1 * | 1/2002 | Yamane et al. | 399/69 |
| 2004/0245235 | A1 * | 12/2004 | Kishi et al. | 219/216 |

FOREIGN PATENT DOCUMENTS

JP 7-199702 A 8/1995

* cited by examiner

*Primary Examiner* — Benjamin Schmitt
(74) *Attorney, Agent, or Firm* — Canon U.S.A., Inc., IP Division

(57) ABSTRACT

In an image forming apparatus, a fixing condition such as a target control temperature of a heater is changed depending on whether a first resistance heating element and a second resistance heating element of the heater are connected in series or in parallel such that a similar fixing performance is achieved regardless of whether the first resistance heating element and the second resistance heating element are connected in series or in parallel.

16 Claims, 13 Drawing Sheets

FIG. 4A
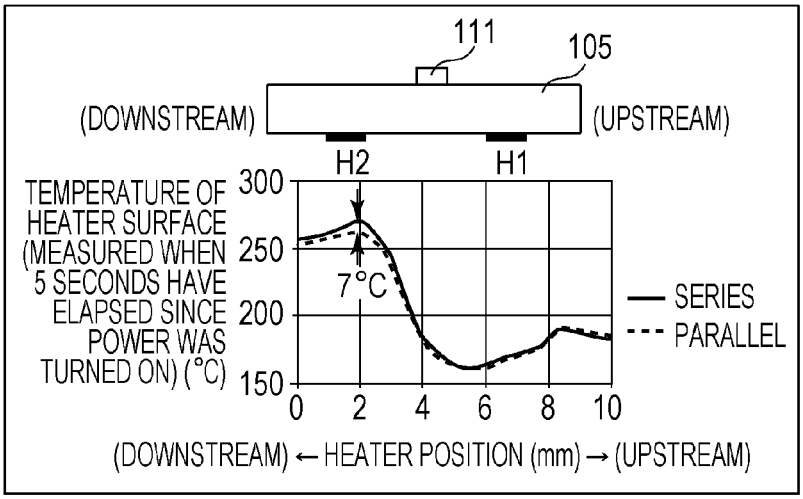
FIG. 4B
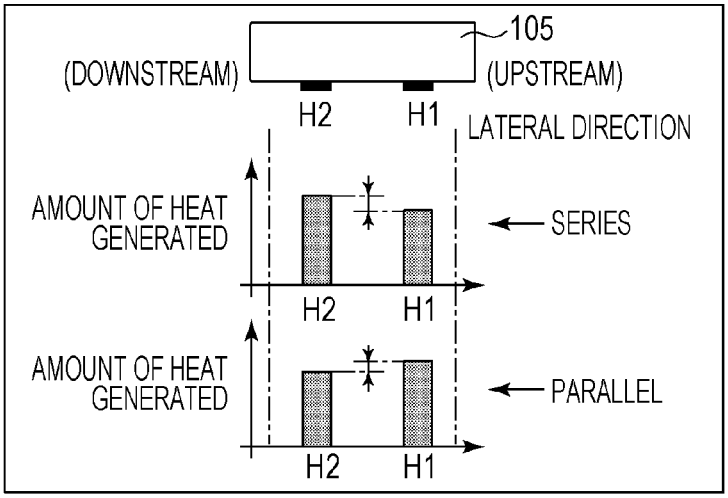
FIG. 4C
| | | | H2 | H1 |
|---|---|---|---|---|
| SERIES | TEMPERATURE | °C | 268 | 189 |
| | RESISTANCE | Ω | 24.9 | 23.3 |
| | GENERATED HEAT | W | 516 | 484 |
| PARALLEL | TEMPERATURE | °C | 261 | 190 |
| | RESISTANCE | Ω | 24.7 | 23.3 |
| | GENERATED HEAT | W | 485 | 515 |

FIG. 5A
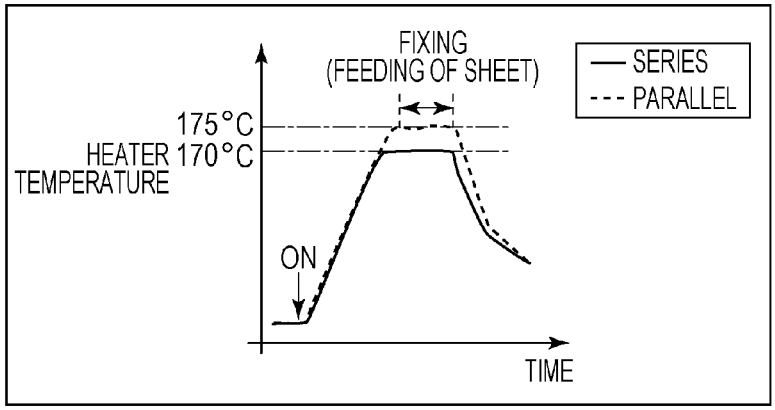
FIG. 5B
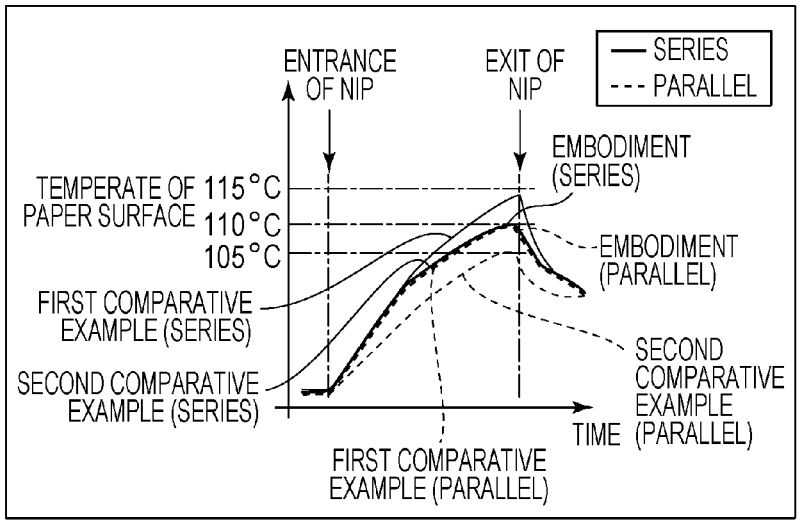
FIG. 5C
| | | TEMPERATURE OF PAPER SURFACE | FIXING PERFORMANCE | OFFSET |
|---|---|---|---|---|
| FIRST EMBODIMENT | SERIES | 110 °C | ○ | ○ |
| | PARALLEL | 110 °C | ○ | ○ |
| FIST COMPARATIVE EXAMPLE | SERIES | 120 °C | ○ | × |
| | PARALLEL | 110 °C | ○ | ○ |
| SECOND COMPARATIVE EXAMPLE | SERIES | 110 °C | ○ | ○ |
| | PARALLEL | 100 °C | × | ○ |
○ : GOOD
× : BAD

| | THRESHOLD VALUE Tth | ERROR DETECTION VALUE Tlim |
|---|---|---|
| 100-V POWER SUPPLY (WHEN CONNECTED IN PARALLEL) | Tth1 = 216 °C | Tlim1 = 221 °C |
| 200-V POWER SUPPLY (WHEN CONNECTED IN SERIES) | Tth2 = 209 °C | Tlim2 = 214 °C |

FIG. 11

| | | COMPARATIVE EXAMPLE | SECOND EMBODIMENT |
|---|---|---|---|
| 100 V | TARGET CONTROL TEMPERATURE | 175 | 175 |
| | Tth | 209 | 216 |
| 200 V | TARGET CONTROL TEMPERATURE | 170 | 170 |
| | Tth | 209 | 209 |

IMAGE FORMING APPARATUS

BACKGROUND OF THE INVENTION

1. Field of the Invention

The present invention relates to an image forming apparatus such as a copying machine, a laser beam printer, etc., and more particularly, to an image forming apparatus including a film-heating-type fixing unit including a heater and a film that moves while sliding on the heater.

2. Description of the Related Art

When an image forming apparatus designed for use in an area where a commercial power supply of a voltage of 100 volts (in nominal value, with an actual value in a range of, for example 100 to 127 volts (hereinafter, such a power supply will be referred to simply as a 100-volt power supply)) is supplied, is used in an area where a commercial power supply of a voltage of 200 volts (in nominal value, with an actual value in a range of, for example 200 to 240 volts (hereinafter, such a power supply will be referred to simply as a 200-volt power supply)), maximum electric power available for a heater in a fixing unit becomes 4 times higher. An increase in the maximum electric power available for the heater can cause a significant increase in a harmonic current or flicker generated during a process of controlling power of the heater by means of a phase control, a wavenumber control, etc. Besides, if thermal runaway occurs in the fixing unit, electric power associated with the thermal runaway is 4 times greater, and thus circuits used need to be capable of quickly responding. Therefore, the most common way to allow a single image forming apparatus to be used in both 100-volt and 200-volt power supply areas is to select a heater with a proper resistance depending on the area and install the selected heater.

A technique has been proposed to realize an apparatus for universal use in both 100-volt and 200-volt commercial power supply areas by switching the resistance of the heater using a relay or other switching devices. More specifically, for example, Japanese Patent Laid-Open No. 7-199702 discloses an apparatus in which first and second resistance heating elements are formed on a heater substrate, and the apparatus is adapted to be capable of switching between a first operation mode in which the first and second resistance heating elements are connected in series and a second operation mode in which the first and second resistance heating elements are connected in parallel whereby it is possible to switch the resistance of the heater depending on the commercial power supply voltage such that the apparatus can be used regardless of where the commercial power supply voltage is 100 volts or 200 volts.

In the technique in which the first and second resistance heating elements are connected in series or in parallel depending on the commercial power supply voltage, it is possible to switch the resistance of the heater without changing the heating area of the heater. In other words, the two resistance heating elements generate heat regardless of whether the apparatus is used in the 100-volt area or 200-volt area, and thus a fixing nip has a constant temperature distribution in a recording sheet conveying direction regardless of the area in which the apparatus is used. As a result, the performance of fixing toner images does not depend on the area in which the apparatus is used.

However, the heat distribution in a lateral direction of a heater can become different between a state in which the two resistance heating elements are connected in series and a state in which the two resistance heating elements are connected in parallel, and this difference can cause a difference in quality of a fixed toner image. An investigation has been performed to find a cause thereof, and it turns out that a temperature distribution in a direction of a film rotation inside the fixing nip can be different between the series connection and the parallel connection, and this different in temperature distribution can cause the above problem. In the fixing apparatus of the film heating type, heat generated by the heater is transferred by the rotating film to a downstream part, and thus the temperature tends to become higher in a downstream part in the fixing nip than in an upstream part during a rotating operation. In general, resistance heating elements have a non-zero TCR (Temperature Coefficient of Resistance). Therefore, the resistance thereof changes with temperature. If a difference occurs in resistance between the two resistance heating elements, there can be a difference in current flowing in each resistance heating element between the series connection and the parallel connection, which can bring about a difference in heat distribution. As a result, a difference occurs in the amount of heat given to a recording sheet passed through the nip between the series connection and the parallel connection, which can create a difference in image quality related to a fixing performance or the like. The difference can be significant in particular when the resistance heating element has a large TCR (Temperature Coefficient of Resistance).

SUMMARY OF THE INVENTION

The present invention provides an image forming apparatus capable of switching a connection mode between a parallel mode in which resistance heating elements are connected in parallel and a series mode in which the resistance heating elements are connected in series depending on a commercial power supply voltage and capable of achieving an equal fixing performance regardless of the connection mode.

In an aspect, the present invention provides an image forming apparatus including an image forming unit configured to form an image on a recording sheet, and a fixing unit configured to fix the image on the recording sheet. The fixing unit includes a heater having a first resistance heating element and a second resistance heating element that are formed on a substrate and that generate heat with electric power supplied from a commercial power supply, a film having a first surface adapted to slide over the heater and a second surface in contact with the recording sheet bearing an unfixed image, a pressing member forming a fixing nip together with the heater via the film to convey the recording sheet while nipping it, and a temperature detecting device configured to detect the temperature of the heater, and the fixing unit is configured such that a connection of the first resistance heating element and the second resistance heating element can be switched between a series connection mode in which they are connected in series and a parallel connection mode in which they are connected in parallel, depending on a voltage of the commercial power supply. The image forming apparatus further includes a control unit that controls electric power supplied to the first resistance heating element and the second resistance heating element from the commercial power supply depending on the temperature detected by the temperature detecting device, and the control unit changes a fixing condition employed by the fixing unit in the fixing of the image depending on whether the first resistance heating element and the second resistance heating element are connected in parallel or in series.

Further features of the present invention will become apparent from the following description of exemplary embodiments with reference to the attached drawings.

BRIEF DESCRIPTION OF THE DRAWINGS

FIGS. 4A, 4B, and 4C diagrams illustrating heat distributions along or across heaters.

FIGS. 5A, 5B, and 5C are diagrams illustrating the temperature of a heater, the temperature of a paper surface, and evaluated image quality.

FIG. 11 is a table illustrating control parameters for a second embodiment of the invention and a comparative example.

DESCRIPTION OF THE EMBODIMENTS

First Embodiment

Figure 1:
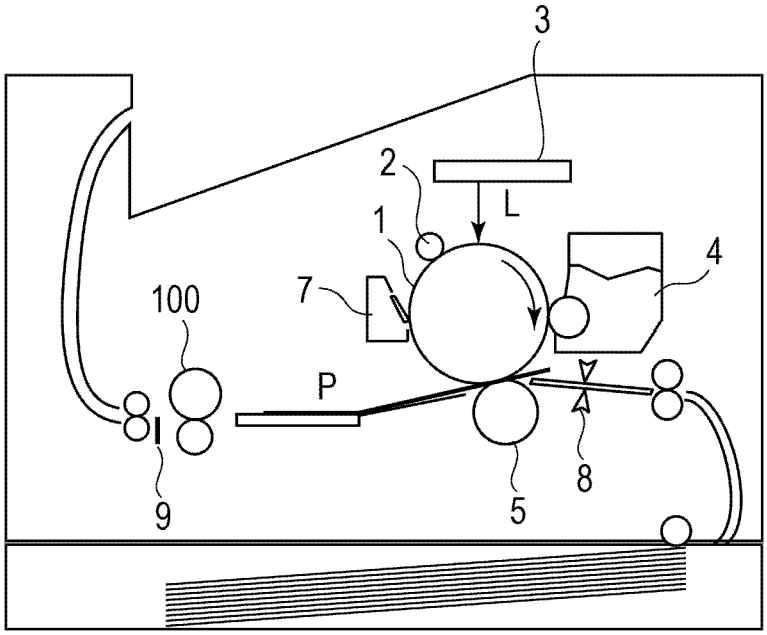
FIG. 1 is a cross-sectional view of an image forming apparatus according to an embodiment of the present invention.

FIG. 1 is a cross-sectional view of an image forming apparatus (a monochrome printer, in this specific example) using electrophotographic recording technology. An image forming unit for forming a toner image on a recording sheet P includes a photosensitive element 1, a charging member 2, a laser scanner 3 configured to emit laser light L according to image information, a developing unit 4, a transfer member 5, and a cleaner 7 for cleaning the photosensitive element. A sensor 8 is provided to detect a leading edge of a recording sheet and generate a trigger signal that causes the laser scanner 3 to start a scanning operation. The operation of the image forming unit is known, and thus a further description thereof is omitted. After an unfixed toner image is transferred to the recording sheet P by the image forming unit, the recording sheet P is sent to a fixing unit 100 and the toner image on the recording sheet P is fixed by heating. A sheet ejection sensor 9 is provided to detect the recording sheet P that has passed through the fixing unit 100.

Figure 2:
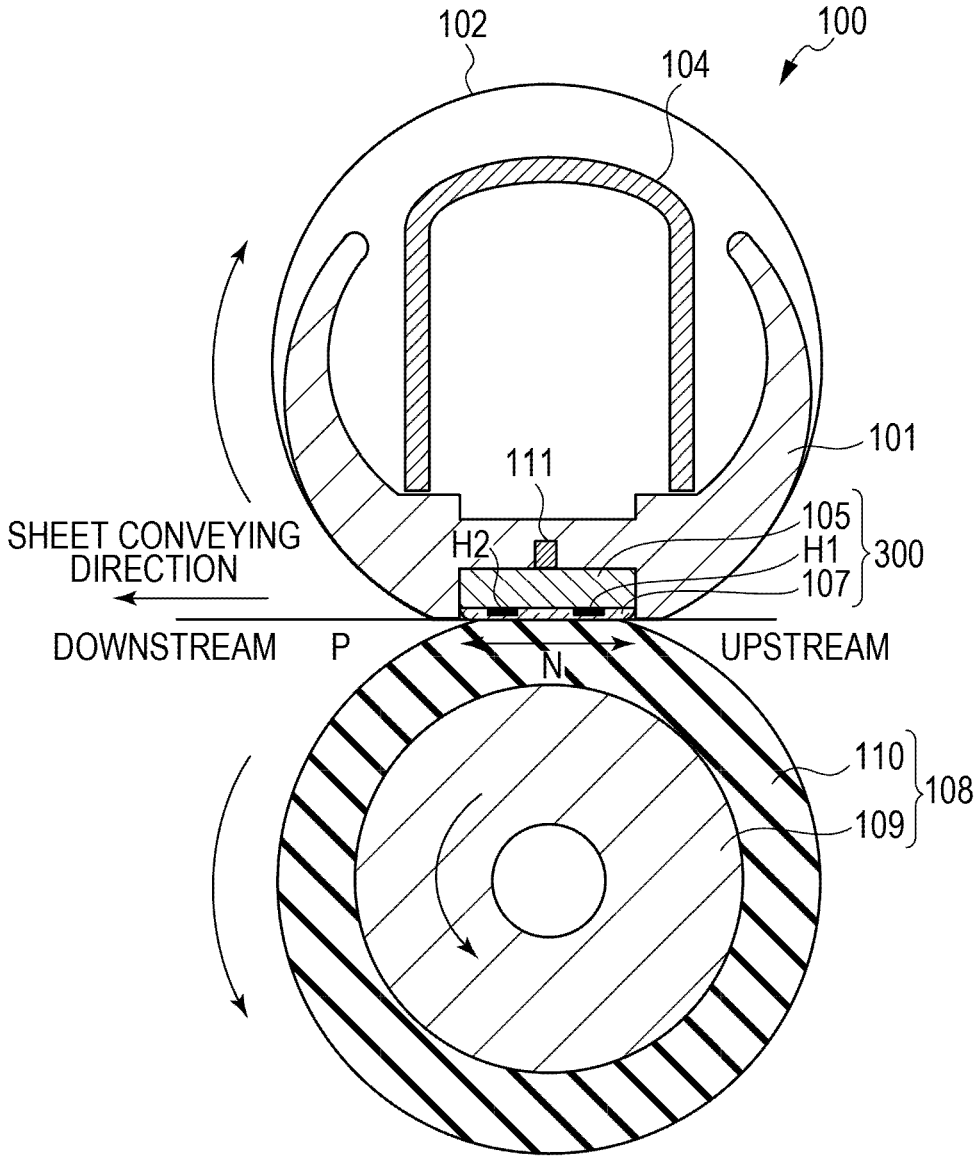
FIG. 2 is a cross-sectional view of a fixing apparatus according to an embodiment of the present invention.

FIG. 2 is a cross-sectional view of the fixing apparatus (fixing unit) 100. The fixing apparatus 100 includes a roll-shaped film (endless belt) 102, a heater 300 located in contact with the inner surface (one surface) of the film 102, and a pressure roller (a nip forming member or a pressing member) 108 forming a fixing nip N together with the heater 300 via the film 102. The film 102 includes a base layer with a thickness of 30 to 70 μm and a release layer with a thickness of 5 to 30 μm formed on the base layer, where the base layer formed of a heat-resistant resin such as polyimide, polyamide, or PEEK (polyetheretherketone), or a metal such as stainless steel, and the release layer is formed of fluorocarbon resin such as PFA (perfluoroalkoxy) or PTFE (polytetrafluoroethylene). The pressure roller 108 includes a core metal 109 made of iron, aluminum, or the like, and an elastic layer 110 made of silicone rubber or the like with a thickness of 2 to 4 mm. The heater 300 includes a heater substrate 105, a resistance heating element H1 (first resistance heating element) and a resistance heating element H2 (second resistance heating element), and a surface protective layer 107 where the heater substrate 105 is made of ceramic such as alumina with a width of 5 to 12 mm and with a thickness of 0.5 to 1 mm, the resistance heating element H1 and the resistance heating element H2 are made of Ag/Pd (silver/palladium) disposed on the substrate 105, and the surface protective layer 107 is formed of an insulating material (glass in this specific embodiment) with a thickness of 0.05 to 0.1 mm covering the resistance heating elements H1 and H2. The heater 300 is held by a supporting member 101 made of a heat-resistant resin such as LCP (Liquid Crystal Polymer). The supporting member 101 also functions as to guide the rotation of the film 102. The pressure roller 108 is urged by a pressing unit (not shown) with a total pressure of 10 to 30 kgf toward the heater 300 via the film 102 such that a fixing nip N with a width of 5 to 11 mm is formed. The pressure roller 108 is driven by a motor (not shown) to rotate in a direction represented by an arrow. When the pressure roller 108 rotates, the film 102 rotates following the rotation of the pressure roller 108 while sliding on the heater.

A temperature detecting device such as a thermistor 111 is disposed in a sheet passage area on the back side of the heater substrate 105 such that the temperature detecting device thermistor 111 is in contact with the heater substrate 105. Depending on the temperature detected by the temperature detecting device 111, the electric power supplied from the commercial AC power supply to the heater (more strictly, to a resistance heating element) is controlled. A recording sheet P bearing an unfixed toner image is heated when it is conveyed while being nipped by a fixing nip N thereby to fix the toner image. A metal stay 104 functions to apply a pressure of a not-shown spring to the supporting member 101.

In the present example, the film 102 has a diameter of 24 mm and includes a base layer made of polyimide with a thickness of 60 μm and a release layer formed thereon of PFA (perfluoroalkoxy) resin with a thickness of 15 μm. The pressure roller 108 has a diameter of 24 mm and includes a core metal made of aluminum with a diameter of 18 mm, an elastic layer formed thereon of silicone rubber with a thickness of 3 mm, and a release layer made of PFA with a thickness of 50 μm. The 7-mm fixing nip N is formed by pressing pressure roller 108 with a total pressure of 15 kgf against the film 102. The rotation of the pressure roller 108 is controlled such that the recording sheet P is conveyed at a speed of 236 mm/sec, which allows a sequence of sheets of LTR-size paper with paper-to-paper intervals of 40 mm to be passed through the fixing nip N at a print speed of 42 ppm.

Figure 3A:
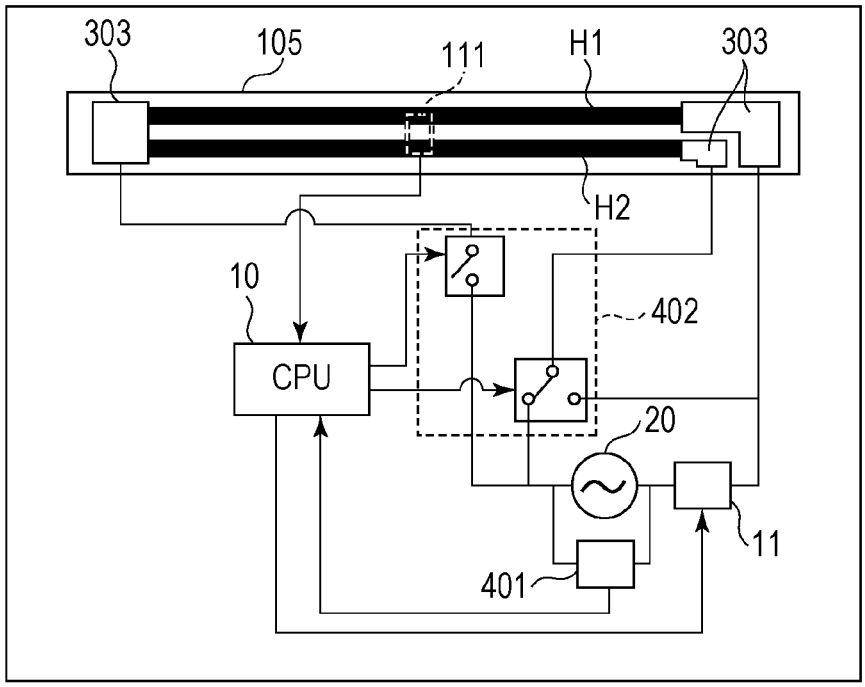
FIGS. 3A and 3B are diagrams illustrating a heat and a voltage detection unit according to an embodiment of the present invention.
Figure 3B:
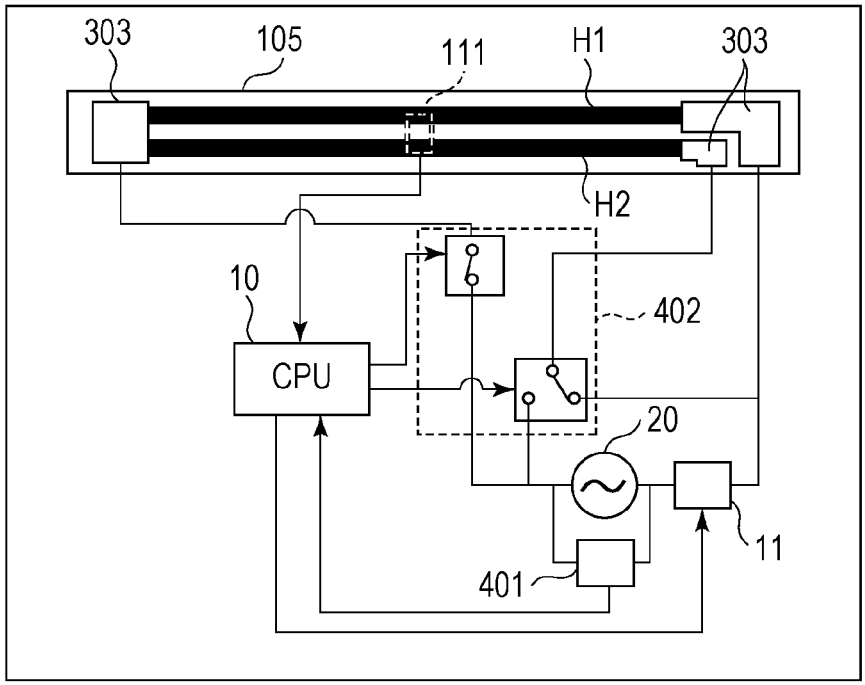

FIGS. 3A and 3B are schematic diagrams illustrating the heater 300 according to the present embodiment of the invention. The heater 300 includes a resistance heating elements H1 and H2 formed on an alumina substrate 105 with a width of 10 mm. A conductor pattern 303 has an electrode for a connection with a connector to receive electric power such that electric power from a commercial power supply 20 is supplied to the first resistance heating element H1 and the second resistance heating element H2 of the heater 300. In the present example, the resistance heating elements H1 and H2 both have a resistance of 20Ω and a TCR of 1000 ppm/° C.

In the fixing apparatus according to the present embodiment, a power supply voltage detector 401 detects the voltage of the commercial power supply 20. Depending on the detected voltage, a CPU 10 controls a relay control unit 402 such that an electric power path to the heater 300 is switched between a series connection and a parallel connection. The power supply voltage detector 401 determines whether the detected effective voltage value is in a range of nominal voltage of 100 volts (for example, a range from 100 volts to 127 volts) or in a range of nominal voltage of 200 volts (for example, a range from 200 volts to 240 volts). When the detected voltage is in the nominal 200-volt range, the resistance heating elements H1 and H2 are connected in series. On the other hand, when the detected voltage is in the nominal 100-volt range, the resistance heating elements H1 and H2 are connected in parallel.

More specifically, when the power supply voltage detector determines that the detected voltage is in the nominal 200-volt range, the relay control unit 402 connects the first resistance heating element H1 and the second resistance heating element H2 in series as shown in FIG. 3A such that the heater has a total resistance of 40Ω. On the other hand, in a case where the voltage detected by the power supply voltage detector is in the nominal 100-volt range, the relay control unit 402 connects the first resistance heating element H1 and the second resistance heating element H2 in parallel as shown in FIG. 3B such that the heater has a total resistance of 10Ω. By switching the total resistance depending on whether the power supply voltage is in the nominal 100-volt or 200-volt range in the above-described manner, it is possible to achieve an equal maximum available power for both the 100-volt and 200-voltage power supply systems.

In the fixing apparatus according to the present embodiment, a target control temperature, which is one of fixing conditions, is set to be different value depending on whether the resistance heating elements are connected in series or parallel. The CPU 10 controls a semiconductor driving device (triac) 11 such that the temperate detected by the temperature detecting device 111 is maintained at the target control temperature. Thus it is possible to suppress the harmonic current, the flicker, or the like that occurs when the electric power to the heater is controlled. Besides, it is possible to achieve an equal fixing performance regardless of whether the first resistance heating element H1 and the second resistance heating element H2 are connected in series or in parallel.

Next, heat generated by the heater during the fixing operation is described below. FIGS. 4A, 4B, and 4C illustrate a temperature distribution of the heater in the lateral direction (the direction in which the film rotates) and a heat distribution during the fixing operation (more specifically, as measured when 5 seconds have elapsed since maximum electric power is supplied) for each connection mode. More specifically, FIG. 4A illustrates a temperature distribution of the heater in a lateral direction for each of the series and parallel connections, and FIG. 4B illustrates amounts of heat generated by the resistance heating elements H1 and H2. FIG. 4C is a table illustrating the temperature, the resistance, and the amount of generated heat, for each of the resistance heating elements H1 and H2.

As can be seen from FIGS. 4A to 4C, in a case in which maximum electric power is applied, when 5 seconds have elapsed since the electric power was applied, the temperatures of the resistance heating elements H1 and H2 reach 189° C. and 268° C., respectively, in the series connection mode while the temperatures reach 190° C. and 261° C., respectively, in the parallel connection mode. the temperature is higher at a downstream side than at an upstream side, and there is a difference of 7° C. in the highest temperate between the downstream and upstream sides. Note that the TCR causes the resistance of the resistance heating elements H1 and H2 to be higher at the downstream side than at the upstream side both in the series and parallel connections (and more specifically, the resistance is about 24.9Ω at the upstream side while the resistance is about 23.3Ω at the downstream side). The heat generated by the resistance heating element H1 is 484 W and that by the resistance heating element H2 is 516 W in the series connection, while the heat generated by the resistance heating element H1 is 515 W and that by the resistance heating element H2 is 485 W in the parallel connection. In the series connection, the heat is generated more at the downstream side than at the upstream side. In the parallel connection, the heat is generated more at the upstream side than at the downstream side. That is, the amount of generated head and the temperature distribution of the resistance heating elements H1 and H2 change depending on whether they are connected in series or parallel.

The differences in the amount of generated heat and the temperature distribution between the series and parallel connection can be brought about by the following factors. In the film-type fixing apparatus, the heat is transferred to the downstream part by the rotating film, and thus the temperature of the heater becomes higher at the downstream side than at the upstream side during the rotating operation. In this state, the heating element H2 located at the downstream side becomes higher in temperature than the heating element H1 at the upstream side, and thus the TCR causes the heating element H2 to have a higher resistance than the heating element H1 (when the TCR is positive). In the case of the series connection, the same amount of current flows through the heating element H1 at the upstream side and the heating element H2 at the downstream side, the resistance heating element H2 having the higher resistance generates a greater amount of heat than the resistance heating element H1 generates. On the other hand, in the parallel connection, the resistance heating element H1 located at the upstream side and the resistance heating element H2 located at the downstream side have separate current paths, and thus the resistance heating element H2 having the higher resistance allows a smaller amount of current to pass therethrough than the current allowed to be passed through the resistance heating element H1 having the lower resistance allows. Thus, a difference occurs in the amount of generated heat depending on the connection mode. Note that in the example shown in FIGS. 4A, 4B, and 4C, maximum electric power is applied at the beginning of the fixing operation. In a case where a plurality of recording sheets are sequentially passed through the fixing apparatus, or in a case where the type of sheets or the mode of passing sheets through the fixing apparatus needs less applied electric power, the difference in temperature distribution tends to become smaller.

In the present embodiment, the temperate is detected at the center of the width in the lateral direction of the heat (i.e., at the center between the resistance heating elements H1 and H2). In this case, if the target control temperature is set to be equal for both the series connection and the parallel connection, the temperature (the highest temperature) of the downstream part of the heater becomes higher in the series connected than in the parallel connection. Therefore, the paper temperature in the fixing operation becomes higher in the series connection than in the parallel connection. As a result, depending on the image pattern or the paper type, a difference in image quality in terms of hot offset of toner, fixing performance, etc., can occur between the series connection and the parallel connection.

In the fixing apparatus according to the present embodiment of the invention, in view of the above, the target control temperature in the series connection is set to be lower than that in the parallel connection such that the amount of heat applied to paper becomes equal regardless of the connection mode. This makes it possible to apply an equal amount of heat to paper (i.e., the temperature of paper) regardless of which connection mode the apparatus is switched to, and thus it becomes possible to achieve similar high image quality regardless of whether the apparatus is in the series connection mode or the parallel connection mode.

FIGS. 5A, 5B, and 5C illustrate a result of evaluation performed on actually printed images in terms of the heater temperature difference, the temperature of recording sheet, and the image quality (the fixing performance and the toner offset) for different supply voltages (200 volts and 100 volts) and different connection modes (the series connection mode and the parallel connection mode). FIG. 5A illustrates a change in heater temperature with time starting at the beginning of the fixing operation during the image forming operation performed by the fixing apparatus according to the present embodiment of the invention. FIG. 5B illustrates a change in the temperature of the paper surface as measured when the paper passes through the fixing nip N. FIG. 5C illustrates the evaluated image quality.

In this specific example, the target control temperature for the 100-volt power supply (in the parallel connection mode) is set to 175° C. while the target control temperature for the 200-volt power supply (in the series connection mode) is set to 170° C. That is, the target control temperature for the 200-volt power supply is set to be lower by 5° C. than that for the target control temperature for the 100-volt power supply. In FIGS. 5B and 5C, for the purpose of comparison, a result is also shown for a case where the target control temperature is set to be equal for both the series connection mode and the parallel connection mode (more specifically, the target control temperature is set to 175° C. in a first comparative example for both the series connection mode and the parallel connection mode, while the target control temperature is set to 170° C. in a second comparative example for both the series connection mode and the parallel connection mode).

As shown in FIGS. 5A to 5C, the heater temperature changes during the fixing operation such that when the operation starts, the temperature increases from room temperature to the target control temperature. While the temperature is maintained at the target control temperature (5° C. lower in the series connection mode than in the parallel connection mode), the operation of passing paper (the fixing operation) is performed. In the evaluation, equal paper temperature of 110° C. was obtained in both the series connection mode and the parallel connection mode, and high-quality images were obtained without degradation in image quality due to a temperature difference or the like. In the first comparative example, the paper temperature in the series connection mode was 120° C., which was higher than that in the parallel connection mode (110° C.), and degradation in hot offset was observed. In the second comparative example, the paper temperature in the parallel connection mode was 100° C., which was lower than that in the series connection mode (110° C.), and degradation in the fixing performance was observed.

In the present embodiment, as described above, the target control temperature in the fixing operation is set to be different depending on the connection mode. Note that other conditions in the fixing operation may be set differently. More specifically, for example, following conditions may be controlled, i.e., the time and the temperature in the pre-rotation before the operation starts, the sheet-to-sheet time intervals and the temperature in the intervals between adjacent sheets in the sequential sheet feeding mode, environmental parameter correction values, the power-on rate of the heater, the processing speed, the applied pressure, etc., depending on whether the heater connection mode such that equal image quality such as fixing performance can be achieved regardless of the heater connection mode. Note that instead of controlling one of the parameters described above, an arbitrary combination of the parameters described above may be controlled.

The difference in the amount of heat generated by the heater and the amount of heat applied to sheets between the heat connection modes varies depending on the processing conditions and the configuration of the apparatus in terms of the material of the heating element of the heater, the TCR thereof, the width of the fixing nip, the temperature detection positions, etc. Therefore, optimum fixing conditions depend on the specific apparatus.

Second Embodiment

Figure 6:
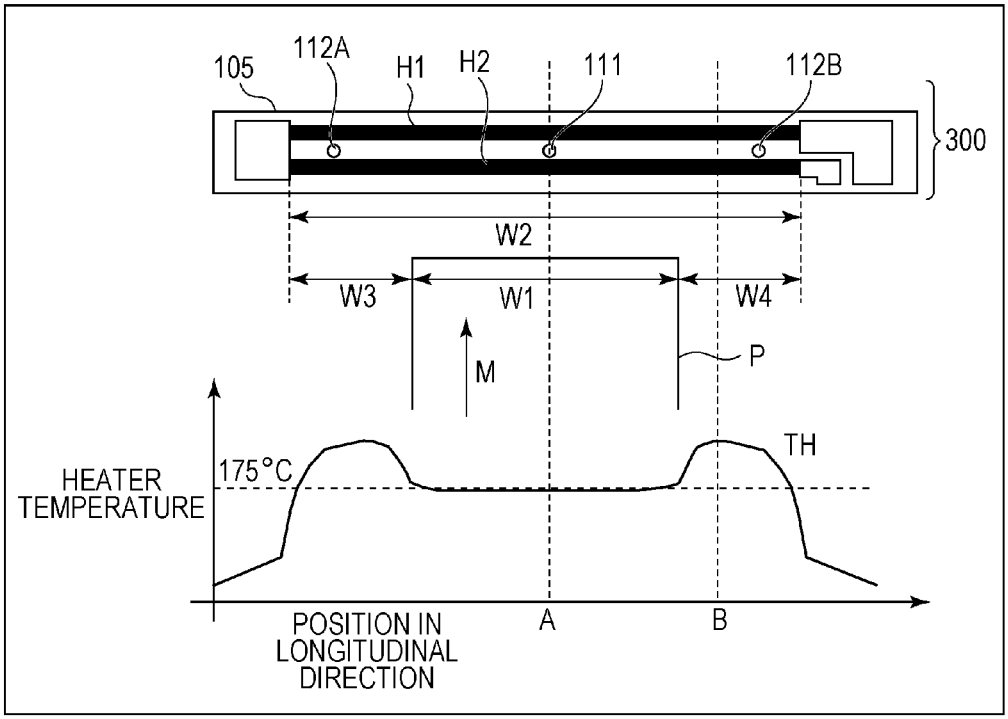
FIG. 6 is a diagram illustrating heater dimensions, a paper size, and a heater temperature distribution.

A second embodiment of the invention is described below. In FIG. 6, a heater 300 includes resistance heating element patterns H1 and H2 formed on an alumina substrate 105. The resistance heating element patterns H1 and H2 each have a longitudinal width W2 of 220 mm extending in a direction crossing a direction M in which a recording sheet P is conveyed. The longitudinal width W2 is set such that a sheet having an LTR size with a lateral width of 215.9 mm, which is the maximum size the image forming apparatus can handle, can be well heated over the whole area of the sheet. During the fixing operation, a current is passed through the resistance heating element patterns H1 and H2 such that heat is generated over their whole areas regardless of the width of the recording sheet. In the case where the heater is configured in the above-described manner, when the width W1 of the recording sheet 51 (hereinafter, the width of the area through which recording sheets pass will also be referred to as a sheet passage area width) is smaller than the width W2 of the resistance heating element patterns H1 and H2, differences W3 and W4 occur between the width W1 of the recording sheet and the width W2 of the resistance heating element patterns H1 and H2. The width W1 is equal to 148 mm for A5-size sheets. The longitudinal width W2 of the heating elements H1 and H2 (hereinafter also referred to as a heating area width W2) is always equal to 220 mm. Thus, difference widths W3 and W4, in which sheets do not pass, occur between W2 and W1. Hereinafter, such areas in which sheets do not pass will be referred to as no-sheet-passage areas.

A thermistor (a first temperature detecting device) 111 detects the heater temperature in the passage area of sheets with a minimum size (A5 size in this specific example) that the image forming apparatus can handle. A fixing process is described below for a case in which A5-size recording sheets are processed while controlling the electric power supplied to the heater 300 such that the temperature detected by the thermistor 111 is maintained at the target control temperature, i.e., 175° C. The resistance heating element patterns H1 and H2 generate heat in the heating area with the width W2. In the sheet passage area with the width W1, thermal energy is consumed to perform the image fixing operation. However, in the non-sheet-passage areas with widths W3 and W4, substantially no thermal energy is consumed, and thus heat is accumulated inside the fixing unit. Therefore, as can be seen from the longitudinal distribution TH of the heater temperature, the temperature in the sheet passage area, whose representative point is on a line A in FIG. 6, is controlled at 175° C., but the non-sheet-passage area, whose representative point is on a line B in FIG. 6, is overheated to a higher temperature. This is called excessive temperature rising in the non-sheet-passage area. The temperatures of the heater in the non-sheet-passage area are detected by sub-thermistors 112A and 112B serving as second temperature detecting devices. That is, the sub-thermistors 112A and 112B detect the heater temperature in the non-sheet-passage areas when the recording sheet used has the minimum size (A5 size in the present example) the image forming apparatus can handle. If the excessive temperature rising in the non-sheet-passage area occurs continuously for a long period, the temperature of the heater supporting member 101 can rise beyond its maximum allowable value. For example, in a case where Zenite 7755 (product name) available from DuPont is used as the material of the heater supporting member 101, the maximum allowable temperature is about 300° C., and thus it is necessary to control the heater such that the temperature does not rise beyond 300° C.

Figure 7A:
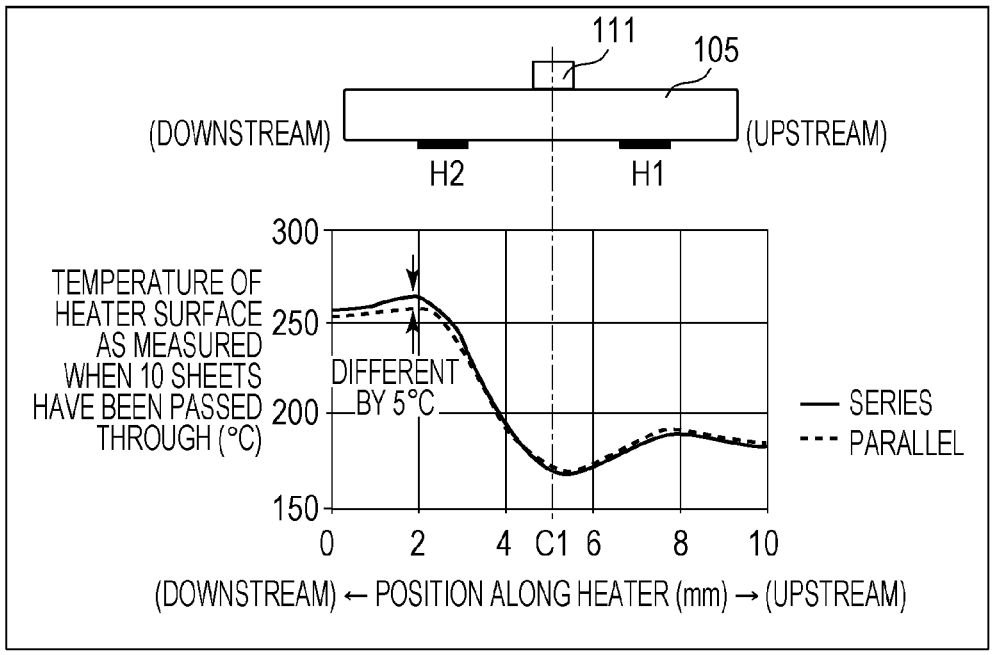
FIGS. 7A and 7B are diagrams illustrating heater temperature distributions.
Figure 7B:
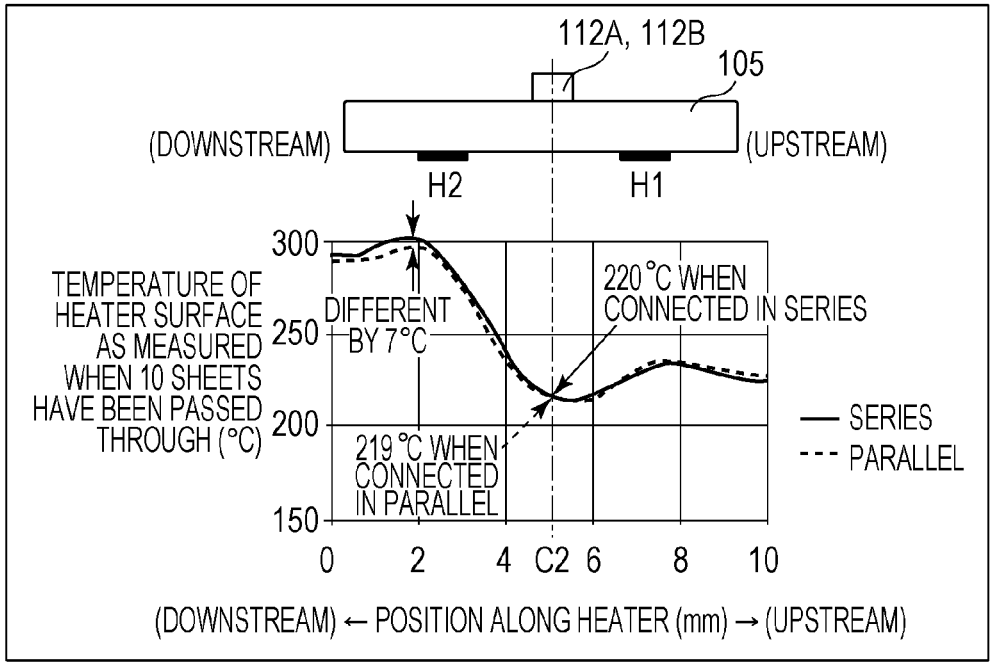

Referring to FIGS. 7A and 7B, the temperature distribution of the heater in the lateral direction is discussed below. FIG. 7A illustrates an example of a temperature distribution of the heater along a line (denoted by A in FIG. 6) that is at the center of the heater in the longitudinal direction. FIG. 7B illustrates an example of a temperature distribution of the heater in the non-sheet-passage area (along the line B in FIG. 6) for a case where 10 sheets of A5-size recording paper are continuously subjected to the fixing operation. In FIGS. 7A and 7B, solid lines indicate temperature distributions in the series connection mode, and dotted lines indicate temperature distributions in the parallel connection mode. At the position shown in FIG. 7A, the heater has a maximum temperature of 263° C. in a downstream part in the series connection mode, while the heater has a maximum temperature of 258° C. in the parallel connection mode. Thus, there is a difference of 5° C. in the maximum temperature between the parallel connection mode and the series connection mode. At the position shown in FIG. 7B, the heater has a maximum temperature of 300° C. in the downstream part in the series connection mode, while the heater has a maximum temperature of 293° C. in the parallel connection mode. Thus, there is a difference of 7° C. in the maximum temperature between the parallel connection mode and the series connection mode. The difference in the temperature distribution between the heater connection mode occurs for the same reason as the in the first embodiment described above.

In view of the above, the heater is controlled such that the temperature detected by the main thermistor 111 is maintained at the target control temperature, and the conveying of recording sheets is controlled such that when at least one of the temperatures detected by the sub-thermistors 112A and 112B reaches a predetermined threshold value, the conveying interval between two adjacent recording sheets is increased. Note that the threshold temperature value is set to be different between the series connection mode and the parallel connection mode. More specifically, the threshold temperature (the first threshold temperature) in the parallel connection mode is set to be higher than that (the second threshold temperature) in the series connection mode.

Figure 8:
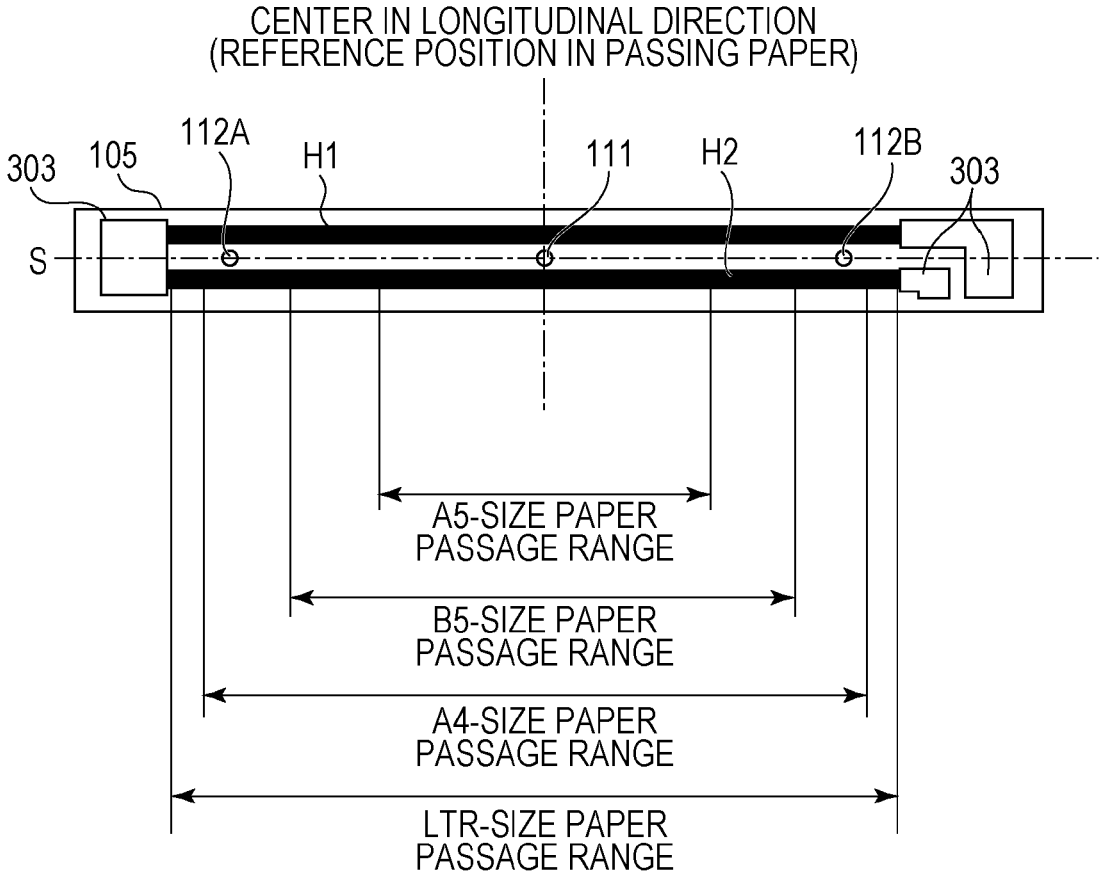
FIG. 8 is a diagram illustrating heater dimensions and paper sizes.

The configuration of the fixing unit and the process of controlling it according to the second embodiment are described in further detail below. FIG. 8 illustrates the heater 105, the main thermistor 111, the sub-thermistors 112A and 112B, and sheet passage areas for various sheet sizes. When seen in the lateral direction, the respective thermistors are on a line S located at the center of the lateral direction of the heater and extending in the longitudinal direction. When seen in the longitudinal direction, the main thermistor 111 is located at the center (sheet passage reference position) in the longitudinal direction of the heater. The sub-thermistors 112A and 112B are located at positions that are symmetrical about the sheet passage reference position and that are in side-edge areas of the sheet passage area for the A4-size recording sheet). When the recording sheet is smaller in width than A4 size, such as a B5-size sheet or an A5-size sheet, the sub-thermistors 112A and 112B are located in the non-sheet-passage areas. In the case where an A4-size recording sheet is passed through such that the recording sheet is positioned with respect to the sheet passage reference position, the two sub-thermistors 112A and 112B are both located in the sheet passage area. However, in a case where the A4-size recording sheet passing through is at a position shifted from the sheet passage reference position, one of the sub-thermistors 112A and 112B is located in the sheet passage area and the other one is in the non-sheet-passage area. In this case, an abnormal temperature increase is observed by the sub-thermistor located in the non-sheet-passage area, and thus such an abnormal state can be detected.

Figures 9A, 9B:
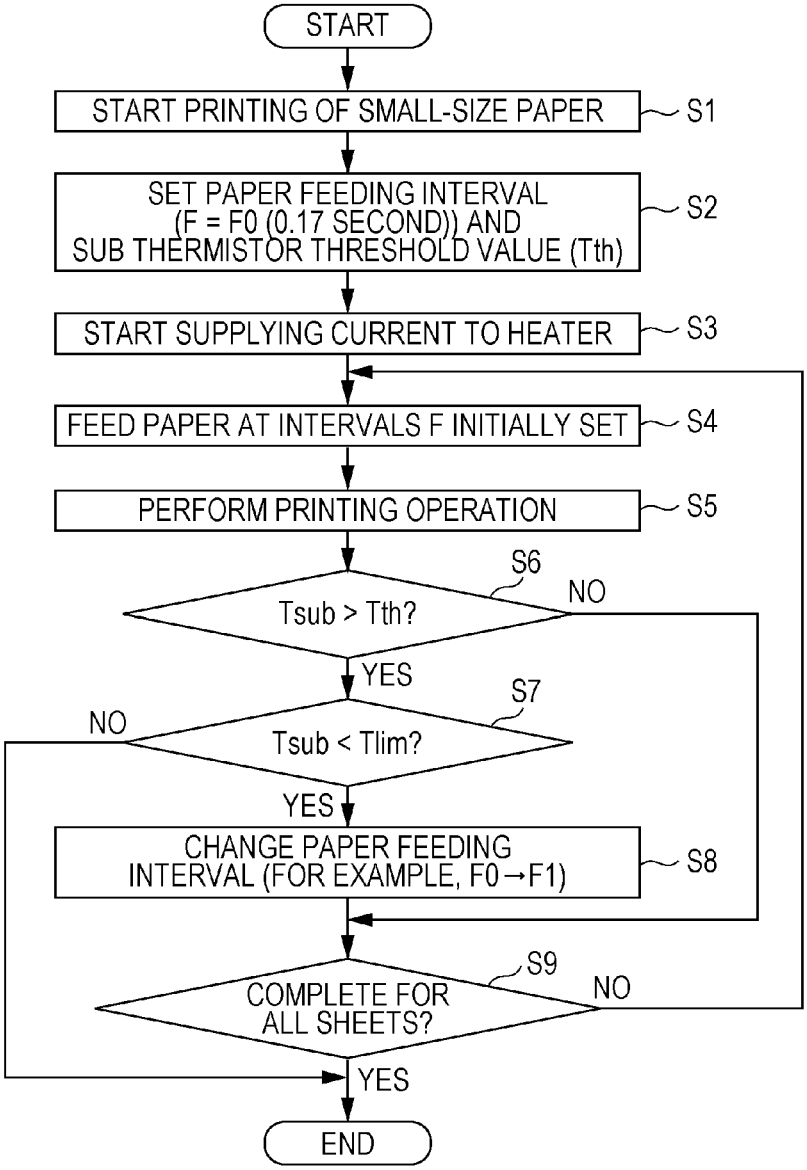
FIG. 9A is a flow chart illustrating a process of treating a recording sheet with a small width.
FIG. 9B is table illustrating relating parameters.

In a case where recording sheets with a small width such as B5-size sheets or A5-size sheets (hereinafter referred to as small-size sheets) are passed through continuously, no heat removal by the recording sheets occurs in the non-sheet-passage areas, and thus the temperatures detected by the sub-thermistors 112A and 112B located in the non-sheet-passage areas increase continuously. In the control process according to the present embodiment, a higher value of the temperatures detected by the two sub-thermistors 112A and 112B is employed as a detection result Tsub. To handle the excessive increase in temperature in the non-sheet-passage areas, it is effective to rotate the fixing unit without supply a sheet until the temperature in the non-sheet-passage areas decreases to a proper value. That is, passing of a sheet through the fixing unit is delayed. Referring to a flow chart shown in FIG. 9, the control process is described in further detail below.

If a print job is started (in step S1), then in step S2, the initial value of the sheet feeding interval is set (F=F0 (0.17 seconds or 42 ppm)) and the threshold temperature Tth of the sub-thermistor is set. In step S3, supplying a current to the heater is started and a sheet is fed. In step S4, sheets are fed at the sheet feeding intervals F. In step S5, a printing operation is performed. In step S2 described above, the threshold temperature Tth of the sub-thermistor is set such that the maximum temperature of the heater is lower than the maximum allowable temperature of the heater supporting member 101 formed of Zenite 7755 (product name) available from DuPont. More specifically, for example, when the maximum allowable temperature of Zenite 7755 is 300° C., the threshold temperature Tth of the sub-thermistor may be set to a value that allows a margin of 10° C. than 300° C., i.e., it may be set such that the maximum temperature of the heater is equal to or lower than 290° C. In a case where a reduction in the margin by 5° C. is detected in step S7, i.e., when maximum temperature becomes equal to or higher than 295° C., an error is detected and the printing operation is ended.

Note that the threshold temperature in the 100-volt power supply (in the parallel connection mode) is set to 216° C. (hereinafter, this threshold temperature will be referred to as Tth1), and the threshold temperature in the 200-volt power supply (in the series connection mode) is set to 209° C. (hereinafter, this threshold temperature will be referred to as Tth2). That is, Tth1 is set to be higher by 7° C. than Tth2. As shown in FIG. 7B, in the parallel connection mode, when the maximum temperature of the upper surface of the heater becomes 293° C., the heater temperature at the point (on a line C2) of 5 mm on the heater where the sub-thermistor is located becomes 219° C. Thus, there is a difference in temperature of 74° C. In the case where the margin is set to 10° C., when the maximum temperature of the heater is 290° C., the temperature at the location of the thermistor is 216° C. Thus, Tth1 is set to 216° C. Similarly, Tth2 is set to 209° C.

The error temperature (at which it is determined that an error occurs) is also set in a similar manner as follows. A sub-thermistor error temperature for the 100-volt power supply in the parallel connection mode (hereinafter referred to as Tlim1) is set to 221° C., and a sub-thermistor error temperature for the 200-volt power supply in the series connection mode (hereinafter referred to as Tlim2) is set to 214° C. That is, Tlim1 is set to be higher by 7° C. than Tlim2. The error temperatures are set to the above values for the following reason. When the absolute maximum allowable temperature of the heater is 300° C., if a margin of 5° C. is set, then the maximum allowable temperature of the upper surface of the heater is 295° C. In this state, the maximum allowable temperatures at a 5-mm position (denoted by C1 FIG. 7A) at which the thermistors is located is set such that Tlim1=221° C. for the 100-volt power supply and Tlim2=214° C. for the 200-volt power supply.

In the second embodiment, as described above, the threshold temperature Tth1 for the 100-volt power supply (in the parallel connection mode) is set to be higher than the threshold temperature Tth2 for the 200-volt power supply (in the series connection mode). By setting the threshold temperatures Tth1 and Tth2 in this manner, it becomes possible to achieve the same maximum heater temperature regardless of the connection mode, and thus it becomes possible to process the same number of sheets per unit time for both the series connection mode and the parallel connection mode. Furthermore, as described above, the error temperature Tlim1 for the 100-volt power supply is set to be higher than the error temperature Tlim2 for the 200-volt power supply.

According to the design theory described above, the respective threshold values Tth1 and Tth2 for the 100-volt power supply and the 200-volt power supply are determined (Tth1>Tth2). If it is determined in step S6 that the temperature Tsub detected by the sub-thermistor is higher than Tth, the process proceeds to a next step. In step S7, the temperature Tsub detected by the sub-thermistor is further monitored. If the detected value of Tsub is not higher than Tlim, the process proceeds to step S8. In a case where the detected value of Tsub is higher than Tlim, an error is detected and the printing operation is ended. In step S8, the sheet feeding interval F is changed for each of the following recording sheets such that F0→F1→F2→F3 and so on. In the second embodiment, the initial value F0 of the sheet feeding interval F is 0.17 seconds (or 42 ppm), and the sheet feeding interval F is changed each time Tth is reached such that F0→F1=1.74 seconds (20 ppm) →F2=4.7 seconds (10 ppm)→F3=10.7 seconds (5 ppm) and so on to allow the fixing unit to rotate in an idle state without receiving sheets for a minimum necessary period to cool down the non-sheet-passage areas. This makes it possible to control the maximum heater temperature to be equal to or lower than the maximum allowable temperature of the heater supporting member 101.

In a case where sheets are of the LTR size of A4 size, the electric power supplied to the heater 105 is controlled such that the temperature detected by the main thermistor 111 is maintained at a particular constant value (for example, 175° C.). In this case, the width of the sheet passage area is almost equal to the longitudinal width of the heater, which means that the non-sheet-passage area is extremely small, and thus an excessive increase in temperature in the non-sheet-passage areas does not occur.

However, in a case where after small-size recording sheets are processed, large-size sheets are processed in a state in which an excessive increase in temperature in the non-sheet-passage areas has occurred, the high temperature in the edge areas of the fixing unit can cause a hot offset to occur in side-edge areas of the sheets. To prevent the above problem, the sub-thermistor 112A and the sub-thermistor 112B check temperatures before the image forming operation is started to determine whether the difference from the temperature detected by the main thermistor is equal to or less than a predetermined value. If the difference from the temperature detected by the main thermistor is greater than the predetermined value, there is a possibility that degradation in image quality such as a hot offset can occur in an edge area where the temperature is high. The temperature is controlled to prevent such a problem.

Figure 10:
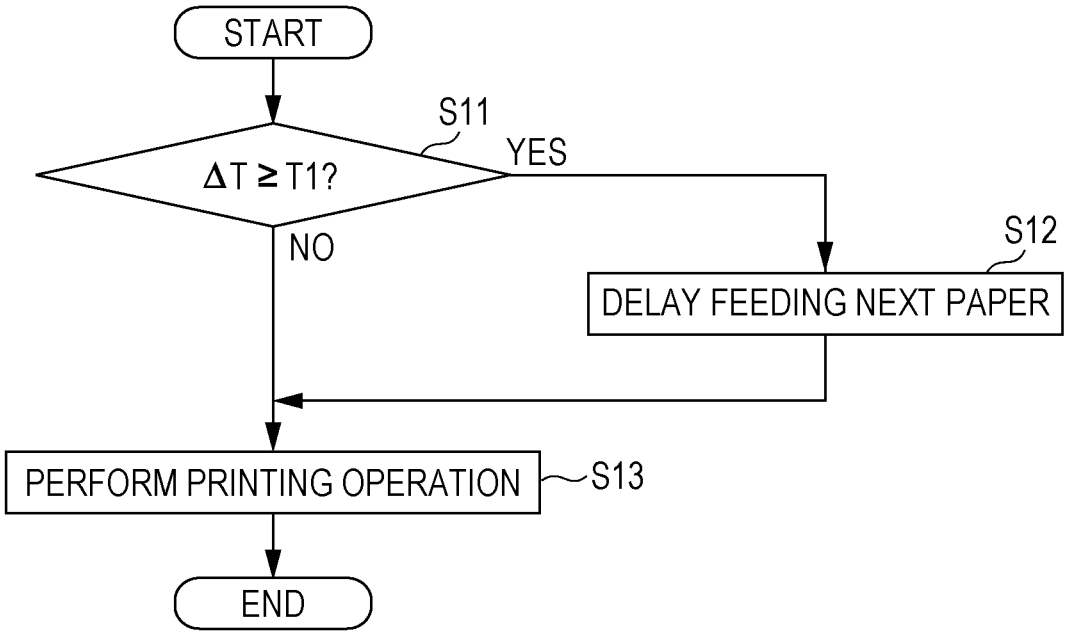
FIG. 10 is a flow chart illustrating a process of processing large-width recording sheets.

More specifically, the temperature is controlled as shown in a flow chart of FIG. 10. In step S11, it is determined whether the difference ΔT between the temperature detected by the main thermistor and the temperature detected by the sub-thermistor is equal to or greater than a predetermined value T1 (30° C. in this specific example). If the difference ΔT is equal to or greater than T1° C., the process proceeds to step S12 to delay the timing of feeding a next sheet such that no sheet is supplied to the fixing nip until the temperatures of the non-sheet-passage areas become sufficiently low. Thus, the temperature is controlled such that the temperature detected by the sub-thermistor, i.e., the temperature in the non-sheet-passage areas does not increase beyond the particular value. In a case where it is determined in step S11 the ΔT is smaller than T1° C., the process proceeds to step S13 to continue the printing operation in the normal manner.

Comparative Example

The embodiment described above is compared with a comparative example in which the threshold values of the sub-thermistors are equally set such that Tth1=Tth2=209° C. In this case, the target control temperature of the main thermistor is set in a similar manner to the first embodiment described above. FIG. 11 illustrates the target control temperature of the main thermistor and the threshold temperature Tth of the sub-thermistor for the second embodiment and the comparative example.

Figure 12A:
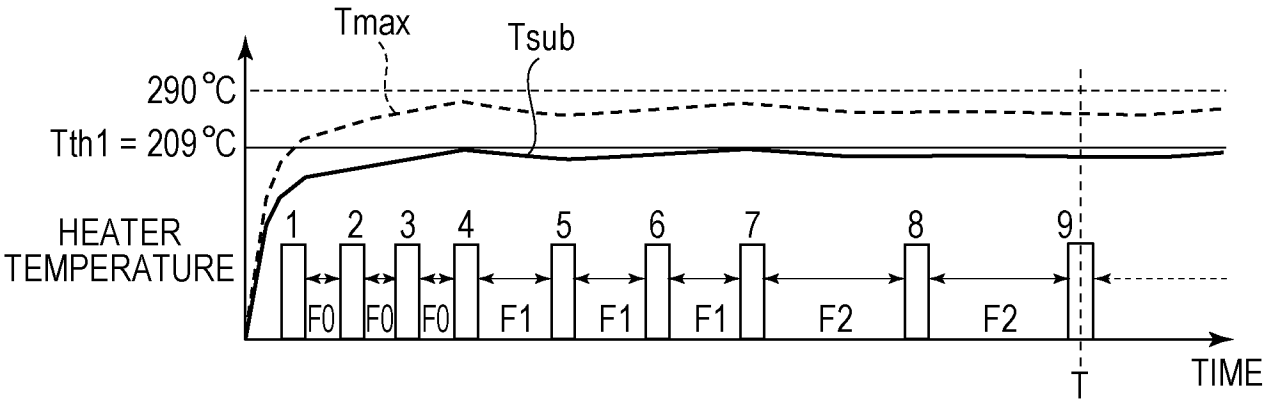
FIGS. 12A and 12B are diagrams illustrating sheet feeding intervals and heater temperature of an image forming apparatus according to a first comparative example.
Figure 12B:
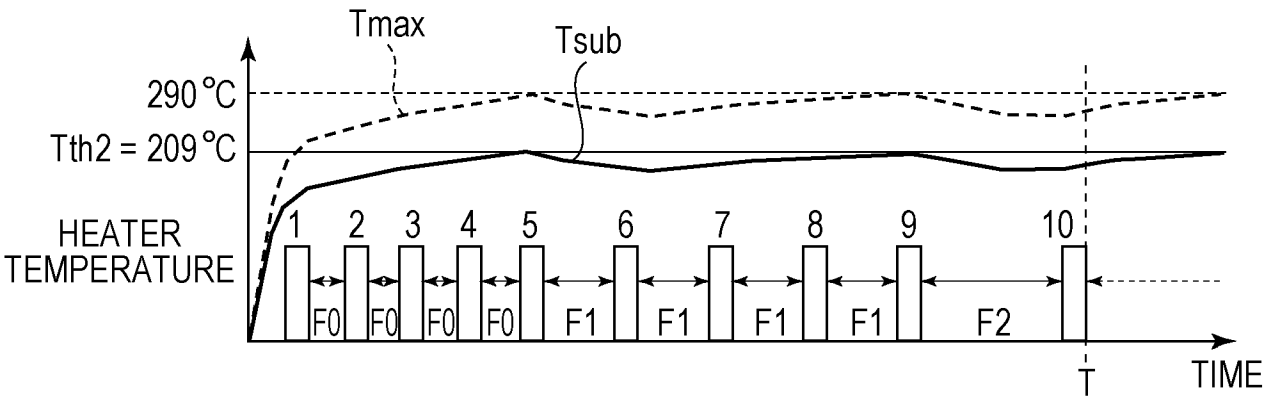

FIG. 12A illustrates a change in the temperature Tsub detected by the sub-thermistor, a change in the maximum temperature Tmax of the upper surface of the heater, and a change in sheet feeding interval, in a case where A5-size sheets are continuously processed by the image forming apparatus with the 100-volt power supply in the comparative example, while FIG. 12B illustrates changes in these parameters for the 200-volt power supply. Referring to FIG. 12A, the result for the 100-volt power supply is described below. Note that the threshold temperature Tth1 of the sub-thermistor is set to the same value, i.e., 209° C. as the value in the series connection mode. However, the temperature distribution of the heater is different from that in the series connection mode, and thus when a fourth sheet is processed, the temperature Tsub detected by the sub-thermistor reaches the threshold temperature Tth1 of the sub-thermistor although Tmax has not yet reached 290° C. As a result, in step S6 and following steps in the flow chart shown in FIG. 9, the sheet feeding interval is changed from F0 to F1. When a seventh sheet is processed, the temperature Tsub detected by the sub-thermistor again reaches the threshold temperature Tth1 of the sub-thermistor, and thus the sheet feeding interval is changed from F1 to F2. As a result, only 9 sheets are processed during a period T shown in FIG. 12A. Next, referring to FIG. 12B, the result for the 200-volt power supply is described below. For first to fifth sheets, the sheets are fed at the sheet feeding interval F0. When the fifth sheet is processed, the temperature Tsub detected by the sub-thermistor reaches the threshold temperature Tth2 of the sub-thermistor, and thus the sheet feeding interval is changed from F0 to F1. When a ninth sheet is processed, the temperature Tsub detected by the sub-thermistor again reaches the threshold temperature Tth2 of the sub-thermistor, and thus the sheet feeding interval is changed from F1 to F2. Thus, the maximum temperature Tmax of the upper surface of the heater is controlled to be lower than 290° C., and 10 sheets are processed during the period T. Thus, in the comparative example, the sheet processing performance is not equal between the 100-volt power supply and the 200-volt power supply. More specifically, in the 100-volt power supply, as shown in FIG. 12A, a potential high performance of the image forming apparatus is not achieved.

Figure 13A:
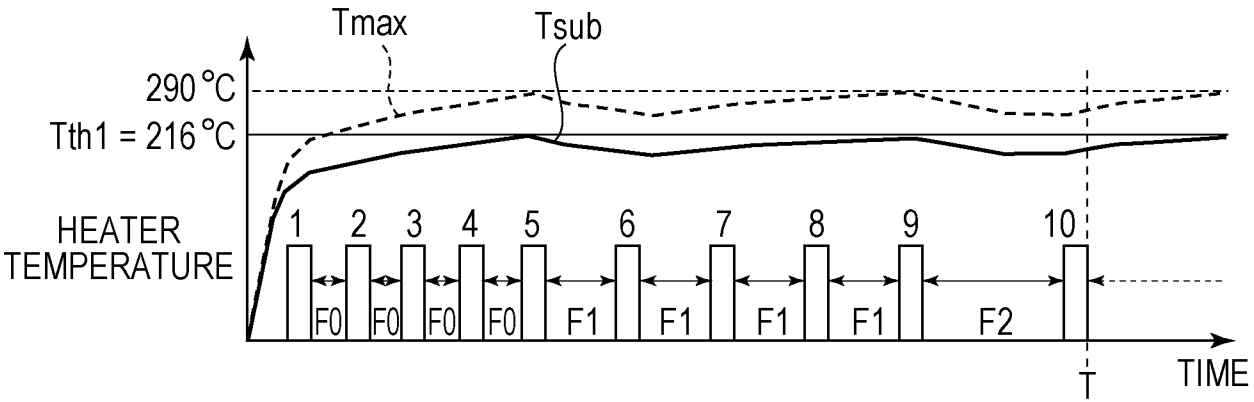
FIGS. 13A and 13B are diagrams illustrating sheet feeding intervals and heater temperature of an image forming apparatus according to a second embodiment of the invention.
Figure 13B:
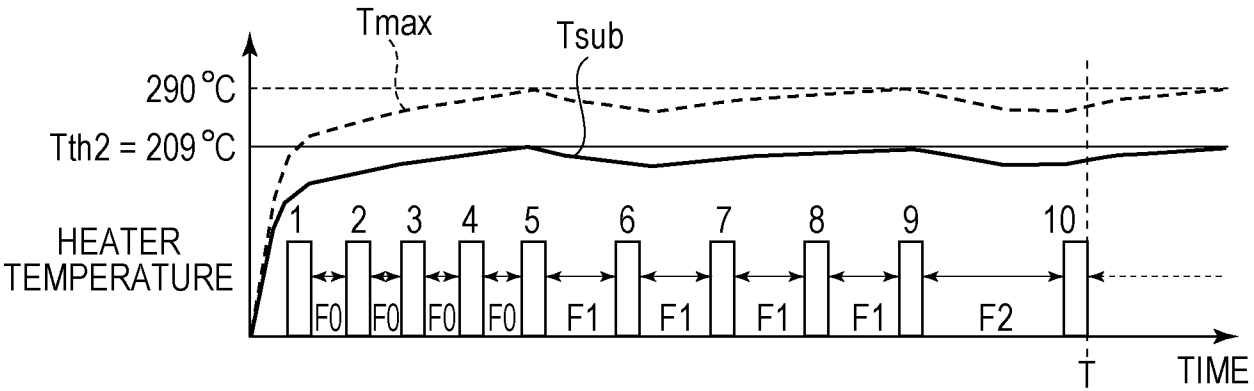

FIG. 13A illustrates a change in the temperature Tsub detected by the sub-thermistor, a change in the maximum temperature Tmax of the upper surface of the heater, and a change in sheet feeding interval, in a case where A5-size sheets are continuously processed by the image forming apparatus with the 100-volt power supply according to the second embodiment, while FIG. 13B illustrates changes in these parameters for the 200-volt power supply.

Referring to FIG. 13A, the result for the 100-volt power supply is described below. In this embodiment, unlike the comparative example, the threshold temperature Tth of the sub-thermistor is set to 216° C., which is higher by 6° C. than is set for the 200-volt power supply. As a result, the maximum temperature Tmax of the upper surface of the heater is controlled to be lower than 290° C., and 10 sheets are processed during the period T. Next, referring to FIG. 13B, the result for the 200-volt power supply is described below. In this case, the target control temperature of the main thermistor and the threshold temperature of the sub-thermistor are both the same as those in the comparative example for the 200-volt power supply, and thus the same result is obtained as in FIG. 12B in terms of the change in temperature and the sheet feeding interval, and 10 sheets are processed in the period T, which is the same as in FIG. 13A. As a result, in the second embodiment, the maximum temperature of the upper surface of the heater can be controlled to lower than Tmax in both the series connection mode and the parallel connection mode, and an equal number of sheets can be processed each unit time in both the series connection mode and the parallel connection mode. As described above, regardless of the connection mode, it is possible to control the maximum heater temperature to be equal to or lower than the maximum allowable temperature of the heater supporting member 101 without causing a reduction in the performance of the image forming apparatus in terms of processing sheets.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-276165 filed Dec. 10, 2010, which is hereby incorporated by reference herein in its entirety.

What is claimed is:

1. An image forming apparatus comprising:

an image forming unit configured to form an image on a recording sheet;

a fixing unit configured to fix the image on the recording sheet, the fixing unit including a heater having a first resistance heating element and a second resistance heating element that are formed on a substrate and that generate heat with electric power supplied from a commercial power supply, a film having a first surface adapted to slide over the heater and a second surface in contact with the recording sheet bearing an unfixed image, a pressing member forming a fixing nip together with the heater via the film to convey the recording sheet while nipping it, and a temperature detecting device configured to detect the temperature of the heater, the fixing unit being configured such that a connection of the first resistance heating element and the second resistance heating element can be switched between a series connection mode in which they are connected in series and a parallel connection mode in which they are connected in parallel, depending on a voltage of the commercial power supply; and a control unit that controls electric power supplied to the first resistance heating element and the second resistance heating element from the commercial power supply depending on the temperature detected by the temperature detecting device, wherein the control unit changes a fixing condition employed by the fixing unit in the fixing of the image depending on whether the first resistance heating element and the second resistance heating element are connected in parallel or in series, wherein the fixing condition is a target control temperature of the heater, and wherein the control unit sets the target control temperature to be higher in the parallel connection mode than in the series connection mode.

2. The image forming apparatus according to claim 1, further comprising a second temperature detecting device for detecting the temperature of the heater in an area in which a recording sheet with a minimum size does not pass, wherein the control unit increases a sheet feeding interval when the temperature detected by the second temperature detecting device reaches a predetermined threshold temperature, and the control unit changes the predetermined threshold temperature depending on whether the first resistance heating element and the second resistance heating element are connected in parallel or in series.

3. The image forming apparatus according to claim 2, wherein the control unit sets the predetermined threshold temperature to be higher in the parallel connection mode than in the series connection mode.

4. An image forming apparatus comprising:

an image forming unit configured to form an image on a recording sheet;

a fixing unit configured to fix the image on the recording sheet, the fixing unit including a heater having a first resistance heating element and a second resistance heating element that are formed on a substrate and that generate heat with electric power supplied from a commercial power supply, a film having a first surface adapted to slide over the heater and a second surface in contact with the recording sheet bearing an unfixed image, a pressing member forming a fixing nip together with the heater via the film to convey the recording sheet while nipping it, a first temperature detecting device configured to detect the temperature of the heater, and a second temperature detecting device for detecting the temperature of the heater in an area in which a recording sheet with a minimum size does not pass, the fixing unit being configured such that a connection of the first resistance heating element and the second resistance heating element can be switched between a series connection mode in which they are connected in series and a parallel connection mode in which they are connected in parallel, depending on a voltage of the commercial power supply; and a control unit that controls electric power supplied to the first resistance heating element and the second resistance heating element from the commercial power supply depending on the temperature detected by the first temperature detecting device, wherein the control unit changes a fixing condition employed by the fixing unit in the fixing of the image depending on whether the first resistance heating element and the second resistance heating element are connected in parallel or in series, and wherein the control unit increases a sheet feeding interval when the temperature detected by the second temperature detecting device reaches a predetermined threshold temperature, and the control unit changes the predetermined threshold temperature depending on whether the first resistance heating element and the second resistance heating element are connected in parallel or in series.

5. The image forming apparatus according to claim 4, wherein the control unit sets the predetermined threshold temperature to be higher in the parallel connection mode than in the series connection mode.

6. An image forming apparatus comprising:

an image forming unit configured to form an image on a recording sheet;

a fixing unit configured to fix the image on the recording sheet, the fixing unit including a rotatable member, a heater being in contact with the rotatable member and having first and second heating elements for generating heat from electric power supplied from a power supply, the fixing unit being switched between a series connection state in which the first and second heating elements are connected in series and a parallel connection state in which the first and second heating elements are connected in parallel depending on a voltage of the power supply; and a control unit configured to control the electric power supplied to the first and second heating elements so that a temperature of the heater is maintained at a target control temperature, wherein the control unit changes the target control temperature in accordance with the connection state of the first and second heating elements, and wherein the control unit sets the target control temperature to be higher in the parallel connection state than in the series connection state.

7. The image forming apparatus according to claim 6, wherein the control unit increases a sheet feeding interval when a temperature of the heater, in an area in which a recording sheet with a minimum size does not pass, reaches a predetermined threshold temperature, and the control unit changes the predetermined threshold temperature in accordance with the connection state of the first and second heating elements.

8. The image forming apparatus according to claim 7, wherein the control unit sets the predetermined threshold temperature to be higher in the parallel connection state than in the series connection state.

9. The image forming apparatus according to claim 6, wherein the heater is in contact with an inner surface of the rotatable member.

10. The image forming apparatus according to claim 9, wherein the fixing unit further includes a pressing member forming a fixing nip together with the heater via the rotatable member to convey the recording sheet while nipping it.

11. The image forming apparatus according to claim 10, wherein the rotatable member is a film.

12. An image forming apparatus comprising:

an image forming unit configured to form an image on a recording sheet;

a fixing unit configured to fix the image on the recording sheet, the fixing unit including a rotatable member, a heater being in contact with the rotatable member and having first and second heating elements for generating heat from electric power supplied from a power supply, the fixing unit being switched between a series connection state in which the first and second heating elements are connected in series and a parallel connection state in which the first and second heating elements are connected in parallel depending on a voltage of the power supply; and a control unit configured to control a sheet feeding interval so that the control unit increases the sheet feeding interval when a temperature of the heater, in an area in which a recording sheet with a minimum size does not pass, reaches a predetermined threshold temperature, wherein the control unit changes the predetermined threshold temperature in accordance with the connection state of the first and second heating elements.

13. The image forming apparatus according to claim 12, wherein the control unit sets the predetermined threshold temperature to be higher in the parallel connection state than in the series connection state.

14. The image forming apparatus according to claim 12, wherein the heater is in contact with an inner surface of the rotatable member.

15. The image forming apparatus according to claim 14, wherein the fixing unit further includes a pressing member forming a fixing nip together with the heater via the rotatable member to convey the recording sheet while nipping it.

16. The image forming apparatus according to claim 15, wherein the rotatable member is a film.

* * * * *